US006701539B1

(12) United States Patent
Hogan

(10) Patent No.: US 6,701,539 B1
(45) Date of Patent: Mar. 9, 2004

(54) MULTI-USE TOILET SEAT ASSEMBLY

(76) Inventor: Sherman David Hogan, P.O. Box 97838, Las Vegas, NV (US) 89193

( * ) Notice: Subject to any disclaimer, the term of this patent is extended or adjusted under 35 U.S.C. 154(b) by 0 days.

(21) Appl. No.: 10/261,572

(22) Filed: Sep. 30, 2002

(51) Int. Cl.[7] ..... A47K 13/06
(52) U.S. Cl. ..... 4/235; 119/162
(58) Field of Search ..... 4/235, 239; 119/162; D23/311

(56) References Cited

U.S. PATENT DOCUMENTS 1,739,001 A * 12/1929 Justus ..... 4/235
2,450,607 A * 10/1948 Oliver ..... 4/445
2,461,160 A * 2/1949 Joyce ..... 4/235
2,544,792 A * 3/1951 Jack ..... 4/239
3,205,510 A * 9/1965 Levine ..... 4/234
5,103,772 A * 4/1992 Schmid ..... 119/162
5,161,263 A * 11/1992 Geneve et al. ..... 4/483

* cited by examiner

*Primary Examiner*—Charles E. Phillips
(74) *Attorney, Agent, or Firm*—Robert Ryan Morishita; Anderson & Morishita, LLC

(57) ABSTRACT

A multi-use toilet seat assembly including an adult toilet seat, a child toilet seat with an optional replaceable diverter to direct urine flow from a male child and an optional animal waste receiver with waste liner insert and further including an optional step for use by a child and or animal and as a foot rest for the child and optional holders for replaceable diverters and waste liners.

6 Claims, 8 Drawing Sheets

MULTI-USE TOILET SEAT ASSEMBLY

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to toilet seat assemblies that will conveniently accommodate an adult, a child, or a pet.

2. Description of the Related Art

U.S. Pat. No. 1,189,767 discloses a series of nested toilet seats having different sized openings therethrough positioned above a toilet bowl such that individuals may each select the toilet seat to be used by such individual and with toilet seats having smaller openings than found in the selected seat being moved out of position by the user.

U.S. Pat. No. 4,461,046 discloses a family toilet seat assembly to be positioned on a toilet and having a first adult toilet seat with a large opening for use by adults, and with the large opening having a surrounding lip that extends downwardly into the toilet bowl and a second child toilet seat having a smaller opening with a lip extending downwardly into the opening of the adult seat and a cover fitting within and spanning the opening of the child toilet seat.

U.S. Pat. No. Des. 309,176 discloses a combination adult and child seat and cover wherein an adult seat has a large opening into a toilet, a child seat fits entirely over the adult seat and has a smaller hole therethrough and a cover fits over both the child seat and the adult seat.

U.S. Pat. No. Des. 356,635 discloses a combination adult and child toilet seat and cover wherein a cover fits on and rests on a child toilet seat, which, in turn, rests on an adult toilet seat. The child and adult toilet seats and the cover appear to have the same peripheral dimensions.

The Internet at EveryBody Potty.com shows a seat assembly having an adult toilet seat and a child toilet seat pivoted to a common hinge and with the child toilet seat arranged to rest on the sides of the top surface of the adult toilet seat. The usual toilet seat cover is also hinged to the common hinge and has an undersurface recessed to fit over the child toilet seat when the cover is closed.

SUMMARY OF THE INVENTION

The invention includes a conventional adult toilet seat having a standard hole therethrough and with the wall of the hole beveled inwardly from the top surface of the seat to the bottom surface thereof. A child toilet seat is hinged to pivot between a raised up position and a lowered position overlying the adult seat. The child toilet seat has a hole therethrough that is aligned with the hole through the adult toilet seat but that is smaller than the standard hole. A cover fits within the smaller hole and has a peripheral edge that is beveled to conform to the beveled edge of the smaller hole. In this fashion, the child toilet seat and cover cooperate to cover the adult toilet seat.

An optional animal waste receiving receptacle is mounted to be positioned between the beveled edge of the cover and to engage the beveled edge of the smaller hole. Air passage is provided through the seat assembly between the adult and child toilet seats that are spaced apart by stops carried beneath the child toilet seat and into a toilet bowl of a toilet on which the adult and child toilet seat assembly is mounted.

The cover is hinged to pivot between an upright position and a lowered position fitting into the smaller hole, with the cover forming a continuation of the seating surface of the child toilet seat. A support arm is pivotally connected to the cover and to the child toilet seat to provide a brace for the cover when the cover is raised. In such an optional embodiment, the cover in the raised position may act as a seat back for a child sitting on the child toilet seat.

The child toilet seat may optionally include a removable combination footrest/step attached thereto to provide a footrest for a child sitting on the child toilet seat and to facilitate a child climbing onto the toilet to sit on the child toilet seat when the child acquires the physical skills necessary for climbing onto the child toilet seat.

The child seat also may optionally include a removable receptacle to receive disposable splash deflectors that will attach to the front edge of the surrounding rim of the hole through the child seat and that will serve to deflect a fluid stream from a boy sitting on the child seat into the toilet on which the toilet seat assembly is mounted.

An optional pet waste receiving receptacle is hinged on the same hinge pin as the child seat and is positioned between the beveled edge surrounding the hole through the child seat and the beveled edge of the cover. The receptacle has a peripheral wall that is slanted inwardly from a top edge to a bottom edge so that the receptacle will rest on the beveled edge of the smaller hole through the child toilet seat and will snugly receive the inclined peripheral edge of the cover. An optional disposable liner is provided to fit into the receptacle and will be positioned over the toilet bowl when the receptacle is separated from the raised cover and is lowered into position resting on the beveled edge of the hole through the child toilet seat. Optionally, the liner will have an adhesive material around at least a portion of the outer rim thereof to be releasably secured to the peripheral edge of the hole through the child toilet seat. A dispenser for holding a supply of the disposable liners is releasably attached to the bottom of the adult toilet seat.

In use, the adult toilet seat, child toilet seat, cover, and, if provided, an optional animal waste receptacle, are all pivoted to proximate the toilet bowl. Access to the interior of the toilet bowl can then be accomplished merely by raising the adult toilet seat together with the child toilet seat, cover, and optional animal waste receptacle. The adult toilet seat can be made ready for use merely by pivoting the child toilet seat to its fully raised position. The adult toilet seat is then ready for use.

The child toilet seat can be made ready for use by leaving the child toilet seat in its fully lowered position and raising the cover and the optional animal waste receptacle that is frictionally secured to the cover, if provided. Thereafter, the optional animal waste receptacle can be separated from the cover and then be fully lowered into engagement with the peripheral edge of the child toilet seat. An optional disposable liner, that is made of material that will entice the animal is placed in the optional animal waste receptacle and the seat assembly is ready for use by a pet, such as a cat. After use by the animal and/or depending upon the needs of adults and children the used disposable liner is removed from attachment to the child toilet seat and is dropped into the toilet bowl to soak and disintegrate so that the toilet may be safely flushed.

DETAILED DESCRIPTION OF THE INVENTION

Figure 1:
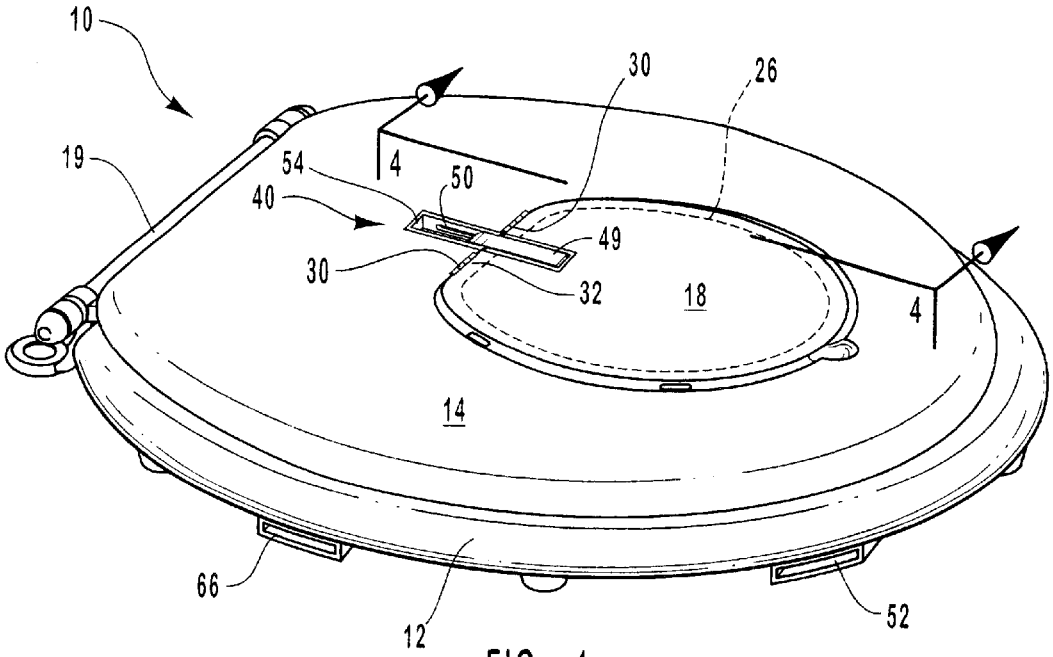
FIG. 1 is a perspective view of the multi-use toilet seat of the invention, with the child toilet seat resting on the adult toilet seat and the animal waste receptacle and the cover closing the opening through the child toilet seat.

Referring now to the drawings:

In the illustrated optional embodiment of the invention the multi-use toilet seat assembly is shown generally at 10. The assembly 10 includes an adult toilet seat 12, a child toilet seat 14, an optional animal waste receptacle 16 and a cover 18.

The adult toilet seat 12 is of generally standard construction for toilet seats and is shaped to fit over the open top of a toilet, not shown. A hinge pin 19 is secured to a rear portion of the adult toilet seat 12 and is adapted to be secured to a toilet in conventional fashion. A hole 20 is provided through the adult toilet seat 12, with a peripheral wall 22 surrounding the hole. The peripheral wall 22 is beveled inwardly from the top of the adult toilet seat 12 to the bottom of the adult toilet seat.

The child toilet seat 14 is hinged on the same hinge pin 19 as the adult toilet seat 12 and the child toilet seat 14 can be pivoted between a lowered position resting on the adult toilet seat 12 and a fully raised position. In the fully lowered position of the child toilet seat 14 the seat is in position to be used by a child and it is only necessary that the optional animal waste receptacle 16, if provided, and the cover 18 be removed from the hole 26, which is smaller than the hole 20, before such use can occur.

Figure 9:
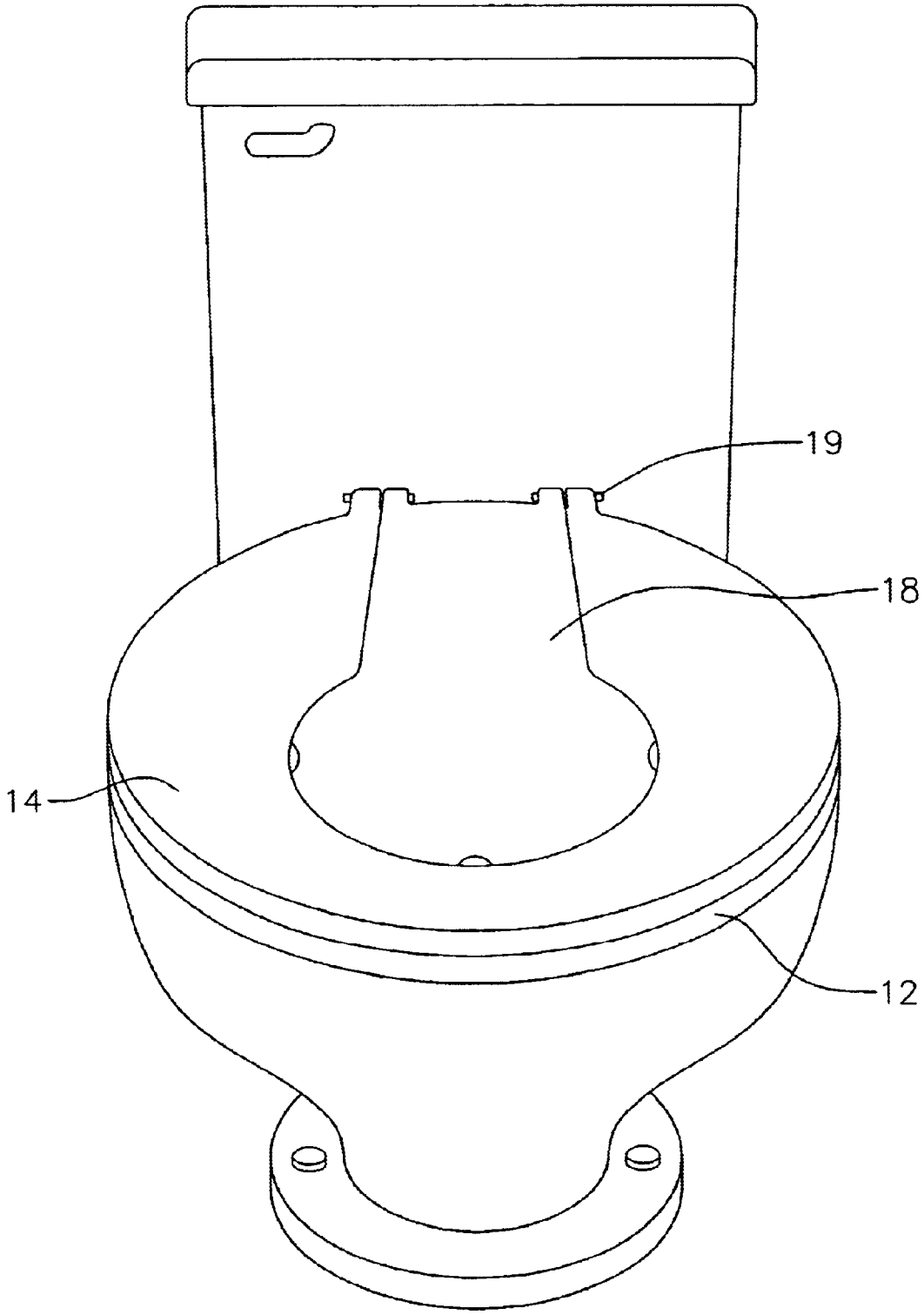
FIG. 9, an elevated perspective view of an alternate optional embodiment of a toilet seat according to the present invention with a cover in a closed position.
Figure 10:
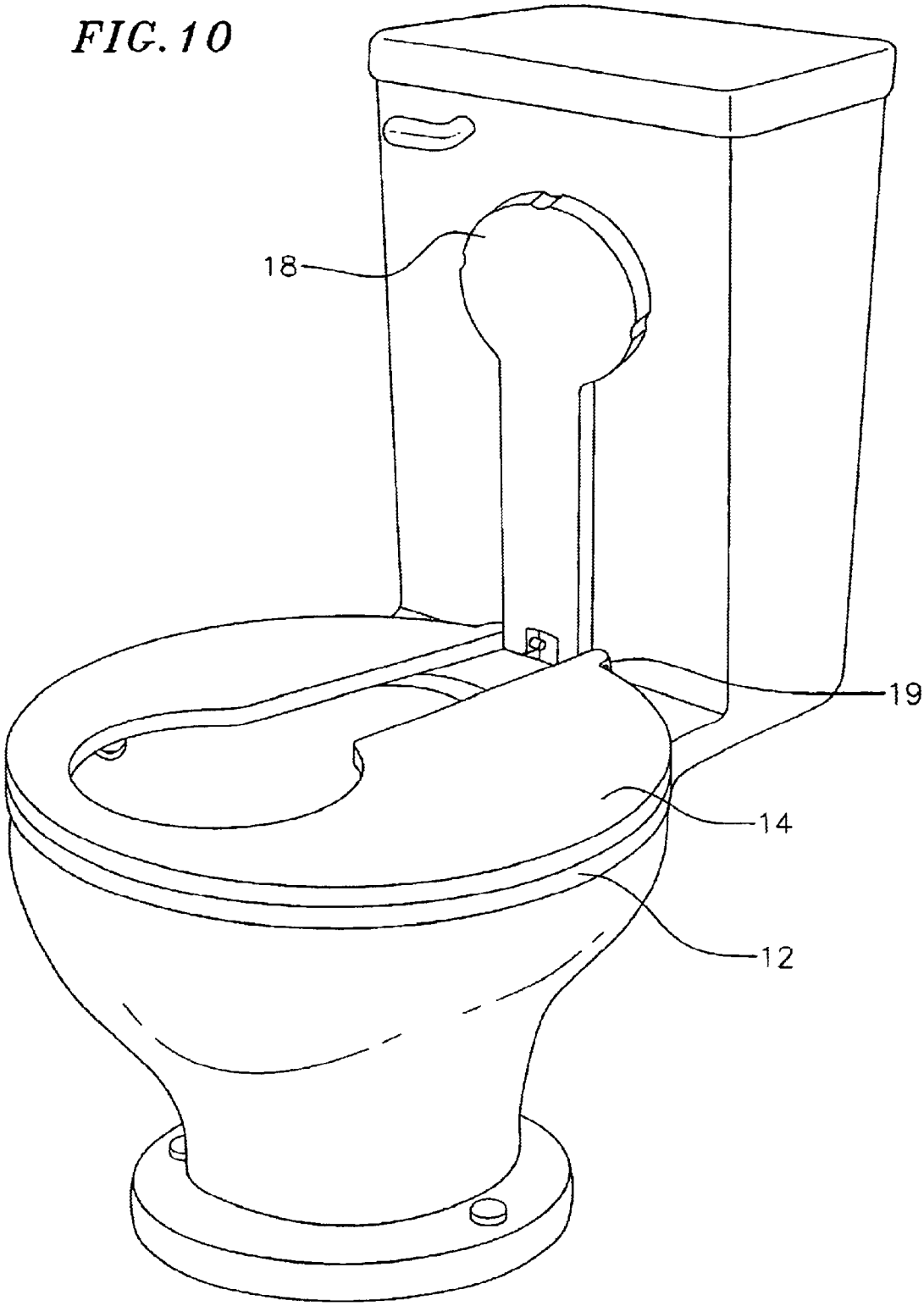
FIG. 10, a perspective view of the optional embodiment of FIG. 9 with a cover in an open position.

It is contemplated that the cover 18 may be hinged to the same hinge pin 19 as the adult toilet seat 12 and the child toilet seat 14 as shown in FIGS. 9 and 10. Alternatively, as shown in FIGS. 1–5, the optional animal waste receptacle and the cover 18 are hinged to a separate hinge pin 30, secured to the child toilet seat 14, between the hole 26 and a rear edge 32 of the child toilet seat 14.

Figure 2:
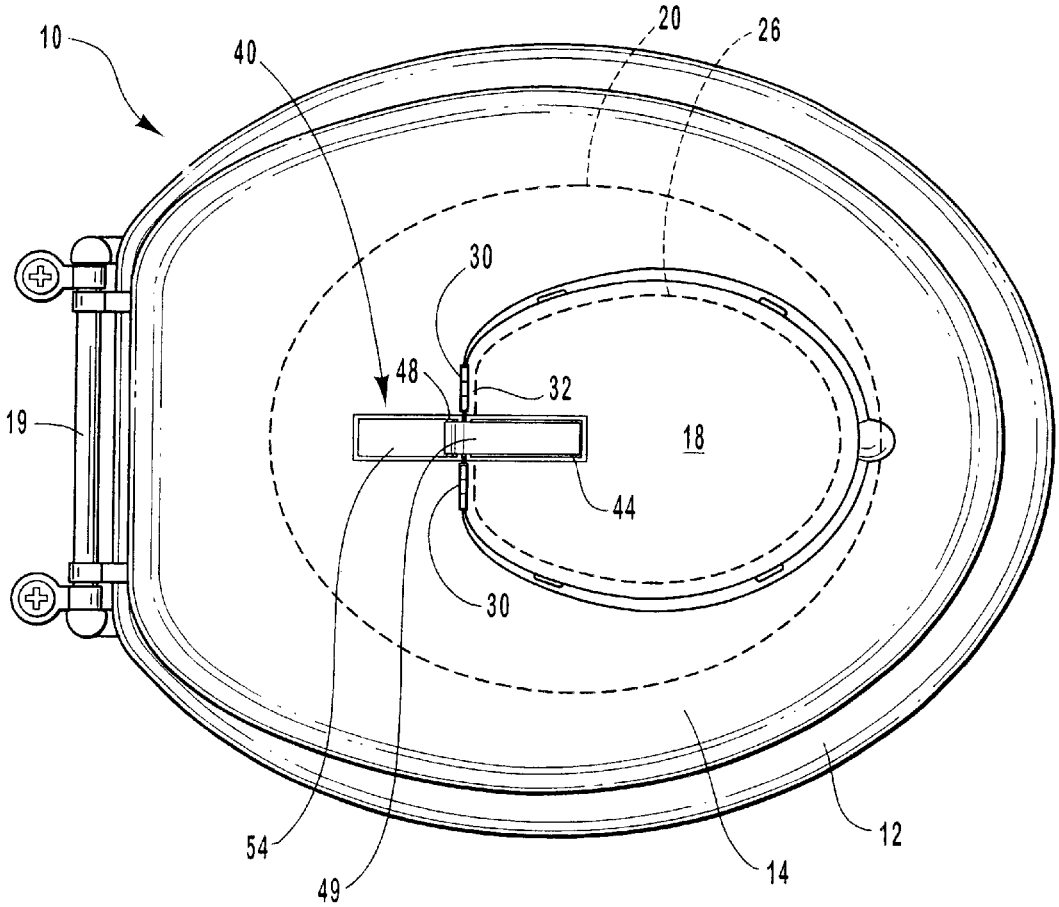
FIG. 2, a top plan view.
Figure 3:
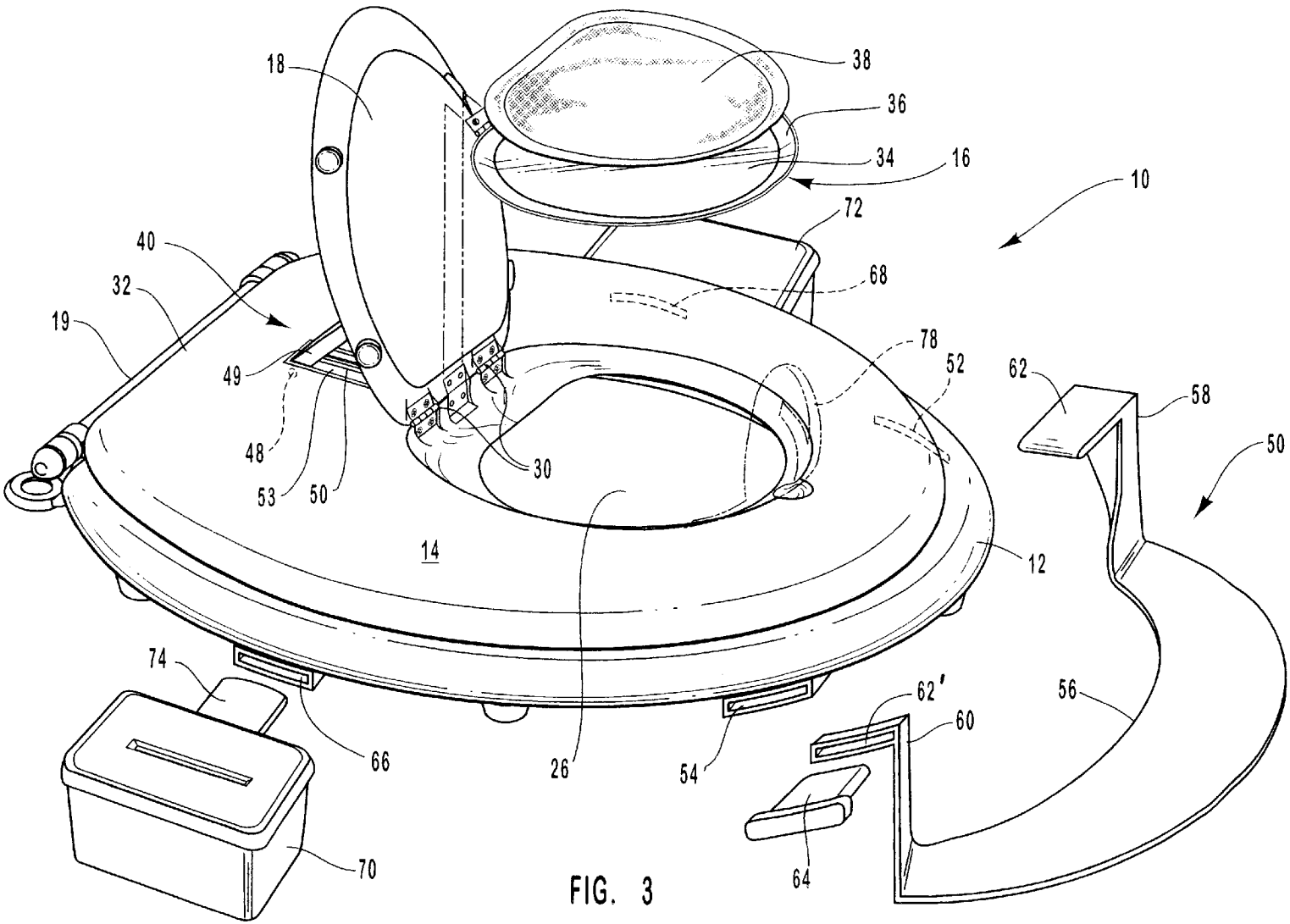
FIG. 3, an exploded perspective view.
Figure 4:
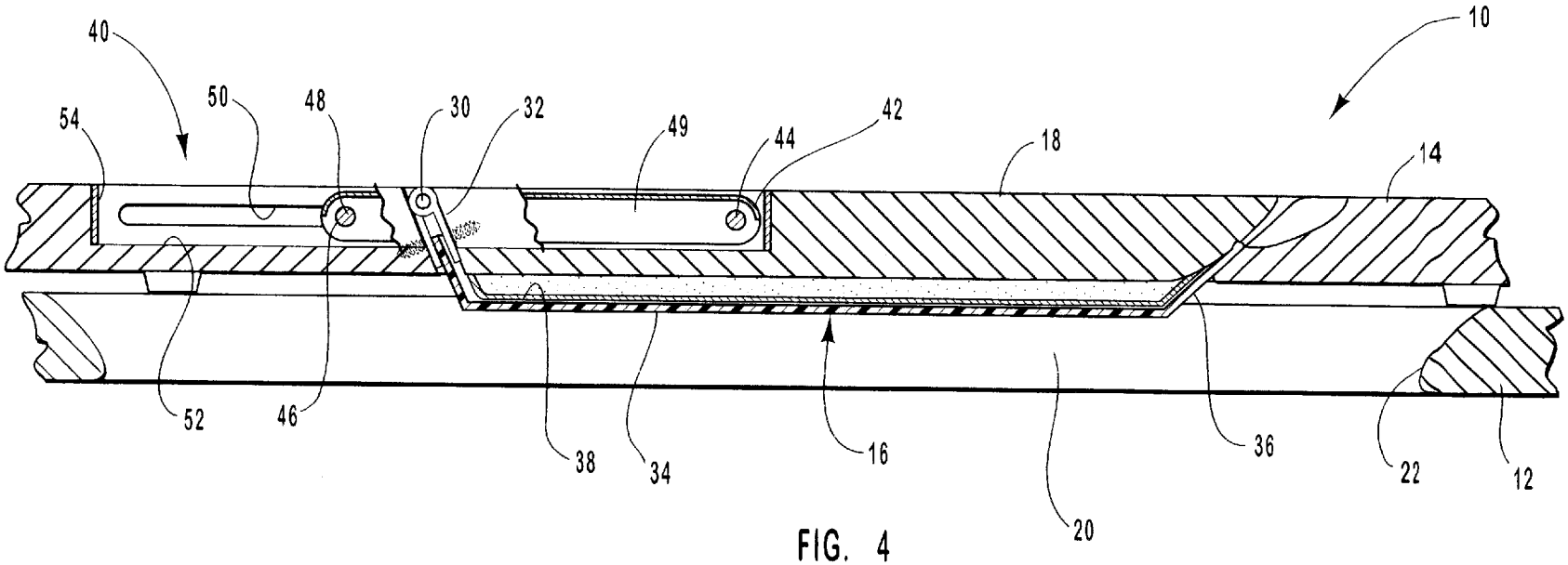
FIG. 4, an enlarged vertical section view taken on the line 4—4 of FIG. 1.
Figure 5:
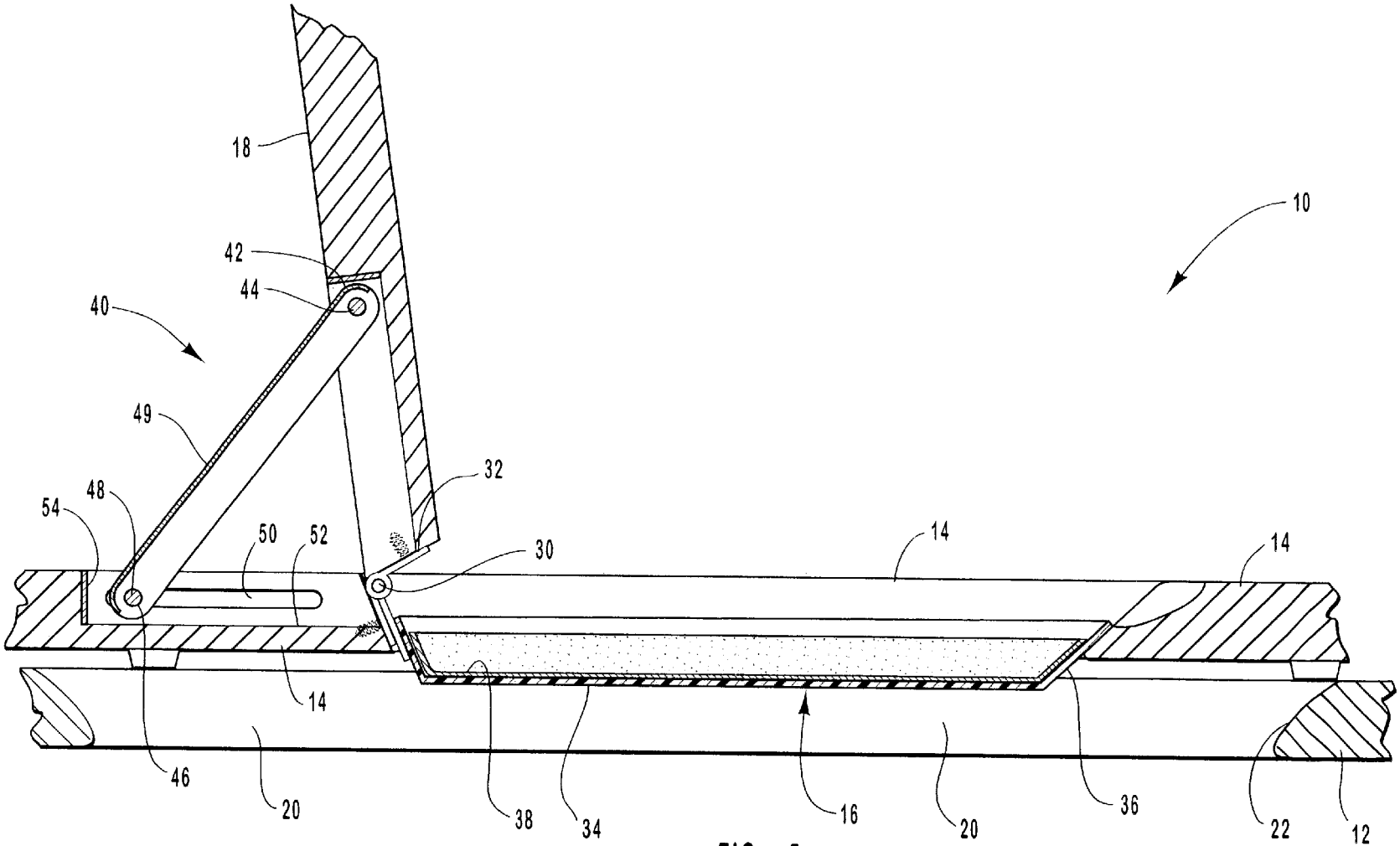
FIG. 5 a view like that of FIG. 4, but with the cover shown in the raised position and including a disposable liner for the animal waste receiving receptacle.
Figure 7:
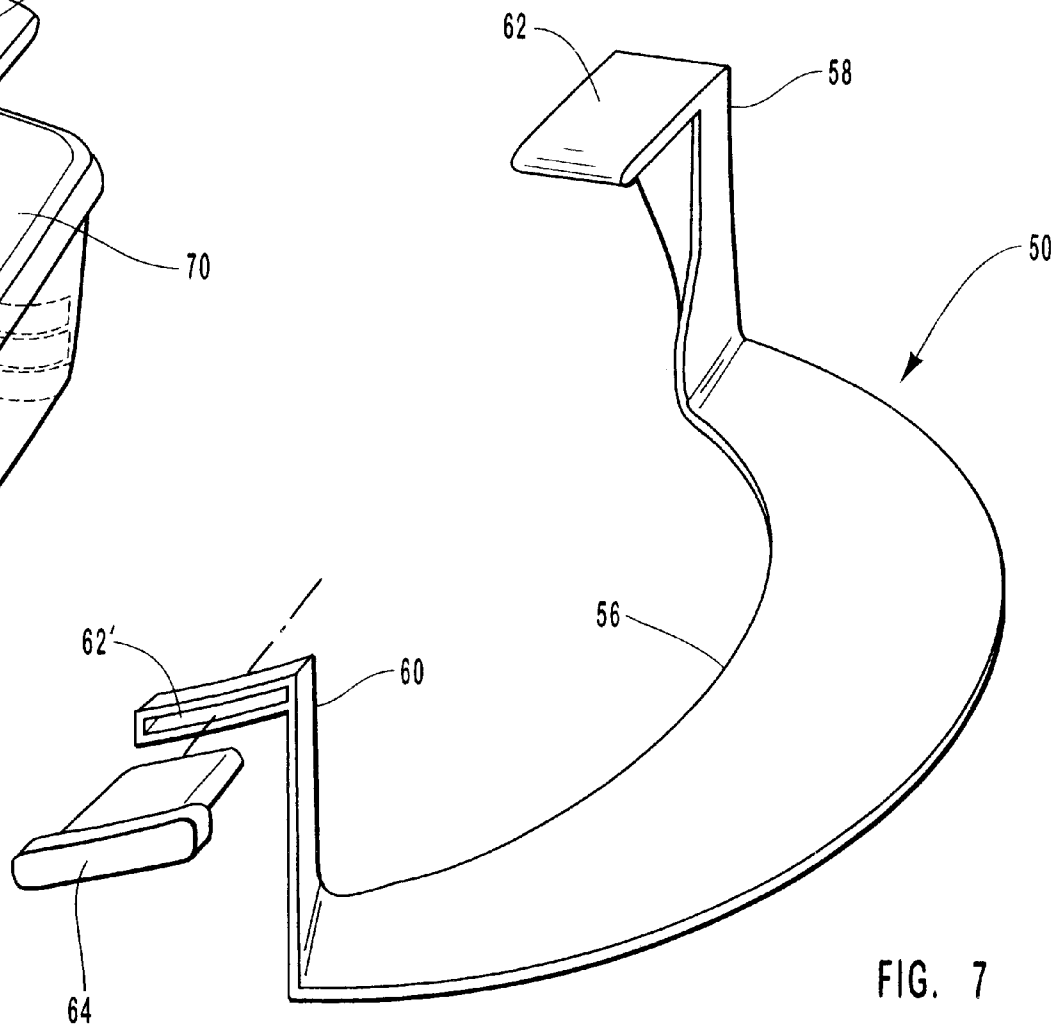
FIG. 7, a perspective view of the detachable step/foot rest.
Figure 6:
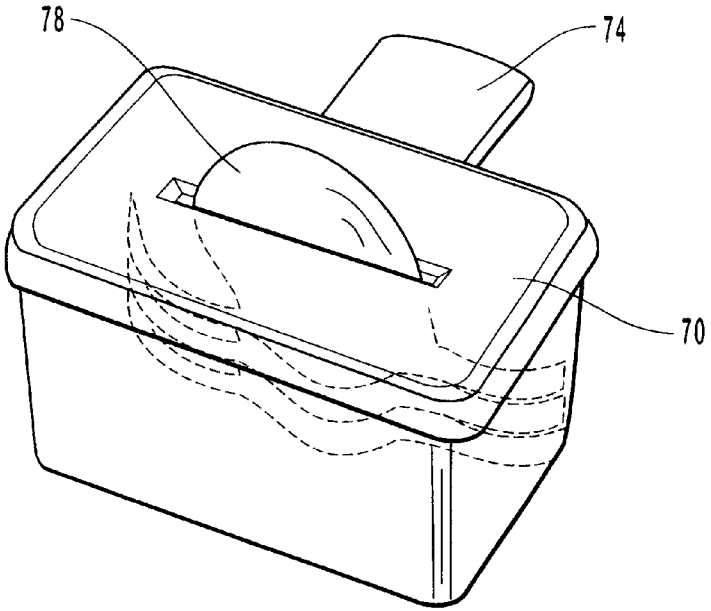
FIG. 6, a perspective view of the detachable receptacle for disposable splash deflectors.
Figure 8:
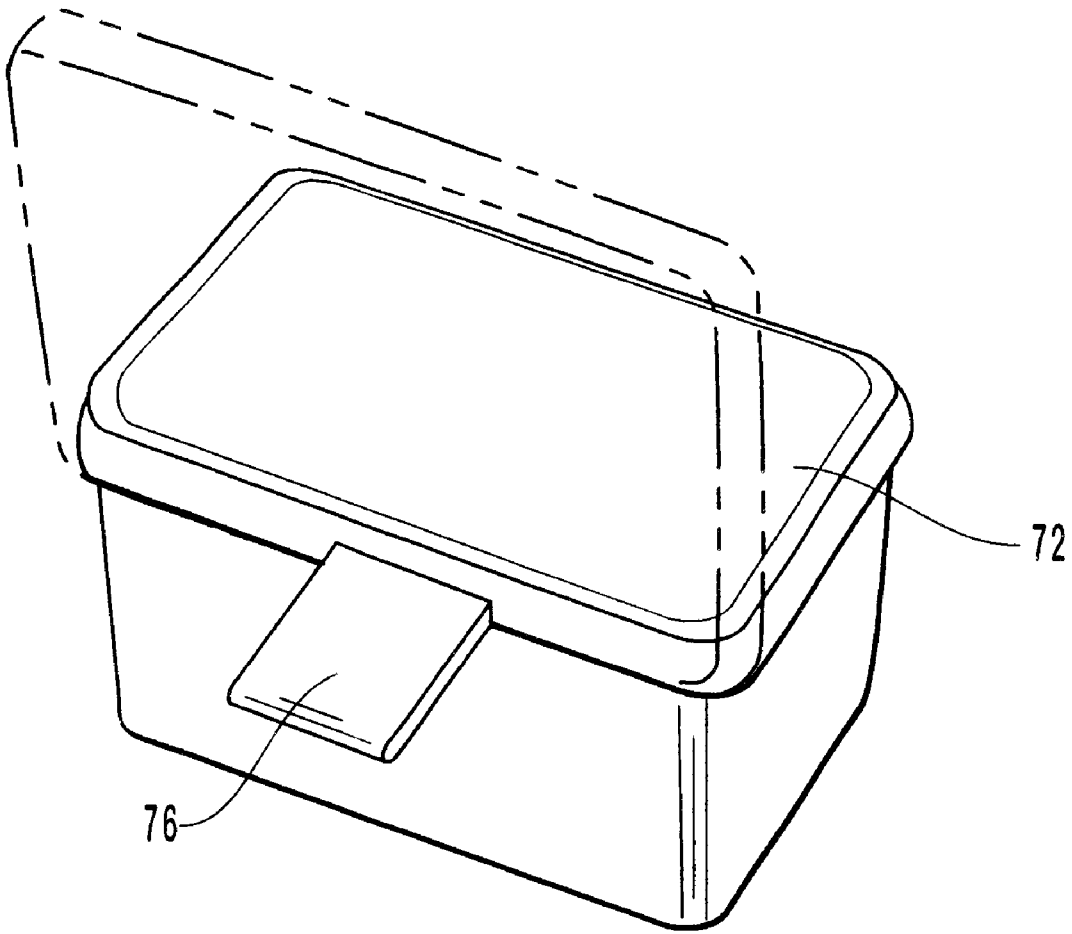
FIG. 8, a perspective view of the animal waste liner dispenser of the invention.

Referring generally to FIGS. 1–8, as previously discussed, an optional animal waste receptacle 16 may be provided. In an optional embodiment in which the optional animal waste receptacle is provided, the animal waste receptacle 16 has a bottom 34, and a flared surrounding wall 36 that will fit into and close the hole 26. The top of the animal waste receptacle 16 is open to snugly receive the cover 18 as a plug when the cover is in its lowermost position and when the cover 18 is pivoted to its fully raised position the animal waste receptacle is raised to its fully raised position along with the cover 18 to which the animal waste receptacle is frictionally engaged. When the cover is separated from the animal waste receptacle and is raised the receptacle remains positioned in the hole 26 and will receive a disposable liner 38 (FIG. 3). The disposable liner 38 may be made of a suitable paper or litter material or a combination thereof that will receive urine and feces from an animal and that will clump and absorb the liquid content of such animal waste while retaining its shape fitting into the animal waste receptacle 16. Periodically, and before use of the adult toilet seat 14 or the child toilet seat 18 the disposable liner 38 and its contents are removed from the animal waste receptacle and are discarded into the toilet bowl if the liner will subsequently dissolve before flushing, or into another trash receiving container, not shown.

Referring again to the cover 18, a brace 40 has one end 42 pivotally attached at 44 to the top of cover 18 and the opposite end of the brace pivotally attached at end 46 of the brace to a pin 48 that slides in slots 50 provided in sidewalls of a groove 52 formed in the top surface of the child toilet seat 14 at a location between the hinge pins 19 and 30. When the cover 18 is raised pin 48 slides rearwardly to engage end 54 of the groove 52. The cover 18 then forms a support to prevent further tipping of the cover and allows the cover to serve as a supported back rest for a child sitting on the child seat. The hinge pins 19 and 30, the telescoping brace 40 and the pivot connections 44 and 46 are all optionally recessed into the child toilet seat 14 and the cover 18 when the child toilet seat and the cover are in their lowered positions, as shown in FIG. 1 and FIG. 2.

An optional step/footrest 50 is suspended from the bottom front of the adult toilet seat. A pair of receiver openings 52 and 54 are provided at opposite sides of the adult toilet seat 12. The step 50 is curved along a front edge 56 so that it will extend around the front edge of a toilet upon which the multi-use toilet seat assembly is attached. Hangars 58 and 60 are provided at opposite ends of the step 50 and are made sufficiently flexible to provide for positioning of the step. Hangar 58 is angled to have a flat finger 62 that extends into the receiver opening 52 and hangar 54 has a slot 62' therethrough so that a flat finger 64 is inserted through and is wedged into the receiver opening 54 to secure the step/footrest to the adult toilet seat 12.

When not in use as a step for a child or an animal such as a cat or as a foot rest for a child the step 50 may be removed by withdrawing the flat finger 64 and then sliding the flat finger 62 from receiver opening 52.

Additional receiver opening slots 66 and 68 may optionally be provided at opposite sides of the bottom of the adult toilet seat. Optional containers 70 and 72 respectively have flat fingers 74 and 76 that extend into the receiver opening slots 66 and 68 to secure the containers to the bottom sides of the adult toilet seat. The optional containers 70 and 72 can hold optional disposable deflectors 78 to be attached to the front of the hole through the child toilet seat and optional disposable liners 38 positioned in and adhesively attached to the interior of the animal waste receptacle. The disposable deflectors 78 are curved to conform to and to be adhesively bonded to the front edge of the hole 26 through the child toilet seat 16 and to extend upwardly to above the top of the seat and downwardly to below the bottom of the seat when a boy child is using the child toilet seat 14. When the boy is finished and is removed from the seat the disposable deflector is removed from attachment to the edge of the hole and is dropped into the toilet bowl to disintegrate and to be flushed away.

Although one form of my invention has been herein disclosed, it is to be understood that the present disclosure is by way of example and that variations are possible without departing from the subject matter coming within the scope of the following claims, which subject matter I regard as my invention.

I claim:

1. A multi-use toilet seat comprising:

an adult toilet seat having an opening formed therethrough, said adult toilet seat connected to a hinge for pivotal securement of said adult toilet seat to a toilet bowl;

a child toilet seat having a hole smaller than the opening through said adult toilet seat, said child toilet seat connected to a hinge to permit pivoting of said child toilet seat between a position overlying the hole through said adult toilet seat and a raised position removed from said hole through said adult toilet seat;

a toilet seat cover having a plug extending into said hole through said child toilet seat when said cover overlies said hole through said child toilet seat, said cover connected to a hinge to permit pivoting of said toilet seat cover to overlie said hole through said child toilet seat such that said cover and said child toilet seat cooperate to form a closure over said large opening through said adult toilet seat, and a raised position in which said smaller hole is exposed; and an animal waste receptacle having a cup extending downwardly into said hole through said child toilet seat and resting on an edge of said hole through said child toilet seat when said receptacle is positioned to overlie said hole through said child toilet seat, and said cup frictionally engaging said plug when said cover is pivoted over said hole through said child toilet seat, said animal waste receptacle attached to a hinge to permit said animal waste receptacle to pivot between a lowered position with said cup extending into said hole through said child toilet seat and a raised position with said cup frictionally engaging said plug when said cover is in its raised position; and a disposable liner to receive animal waste in said cup, said liner being made of material that will disintegrate when soaked in water.

2. A multi-use toilet seat as in claim 1, further including a child foot rest/step removably attached to and suspended from a front of the adult toilet seat.

3. A multi-use toilet seat as in claim 1, further including a disposable diverter releasably attached to the edge surrounding the hole through the child toilet seat at a forward portion of said edge.

4. A multi-use toilet seat as in claim 3, further including means on the adult toilet seat for securing a holder for disposable diverters thereto and a holder for disposable diverters removably secured to said means on said adult toilet seat for securing a holder for disposable diverters thereto.

5. A multi-use toilet seat as in claim 4, further including means on the adult toilet seat for securing a holder for animal waste liners thereto and a holder for animal waste liners removably secured to said means on said adult toilet seat for securing a holder for animal waste liners thereto.

6. A multi-use toilet seat as in claim 1, further including means on the adult toilet seat for securing a holder for animal waste liners thereto and a holder for animal waste liners removably secured to said means on said adult toilet seat for securing a holder for animal waste liners thereto.

* * * * *